US010273750B2

(12) United States Patent
Fleischman et al.

(10) Patent No.: US 10,273,750 B2
(45) Date of Patent: Apr. 30, 2019

(54) ROLL-UP WALL SYSTEM AND MODULAR COMPONENTS

(71) Applicants: Jacob Fleischman, Brooklyn, NY (US); Joel Klein, Brooklyn, NY (US)

(72) Inventors: Jacob Fleischman, Brooklyn, NY (US); Joel Klein, Brooklyn, NY (US)

( * ) Notice: Subject to any disclaimer, the term of this patent is extended or adjusted under 35 U.S.C. 154(b) by 22 days.

(21) Appl. No.: 15/181,344

(22) Filed: Jun. 13, 2016

(65) Prior Publication Data

US 2017/0037616 A1 Feb. 9, 2017

Related U.S. Application Data

(63) Continuation-in-part of application No. PCT/US2015/031258, filed on May 15, 2015, and a (Continued)

(51) Int. Cl.
*E06B 9/58* (2006.01)
*E04B 2/74* (2006.01)

(52) U.S. Cl.
CPC ..... *E06B 9/58* (2013.01); *E04B 2/7433* (2013.01); *E04B 2002/7446* (2013.01); *E04B 2002/7479* (2013.01)

(58) Field of Classification Search
CPC ..... E06B 9/08; E06B 9/17046; E06B 9/40; E06B 9/42; E06B 9/54; E06B 2009/546; E06B 9/58; E06B 9/581

(Continued)

(56) References Cited

U.S. PATENT DOCUMENTS 726,801 A 4/1903 Maxwell
2,516,020 A 7/1950 Reed (Continued)

FOREIGN PATENT DOCUMENTS

AU 2009212839 A1 * 3/2010 ..... E04F 10/0607
EP 0841442 B2 8/2000

(Continued)

OTHER PUBLICATIONS

International Search Report, PCT/US2015/031258, Jacob Fleischman and Joel Klein, pp. 2, dated Sep. 16, 2015.

(Continued)

*Primary Examiner* — Katherine W Mitchell
*Assistant Examiner* — Jeremy C Ramsey
(74) *Attorney, Agent, or Firm* — Law Office of Arthur M. Antonelli, PLLC

(57) ABSTRACT

The present invention relates to a track for connecting a pair of flexible membrane barrier segments in a retractable wall system. The track may include an elongated member having a first longitudinal axis and a first cross-sectional profile perpendicular to the first longitudinal axis. The track may include a base surface and a latching surface. The latching surface may be spaced from the base surface and may include a first groove aligned with the first longitudinal axis, a second groove spaced from the first groove, a projecting element located between the first groove and the second groove, the projecting element being aligned with the first longitudinal axis. The latching surface may further include a hooking element spaced from the projecting element, and a guide surface disposed between the projecting element and the hooking element.

20 Claims, 17 Drawing Sheets

Related U.S. Application Data continuation-in-part of application No. 14/776,737, filed as application No. PCT/US2014/030073 on Mar. 15, 2014, now abandoned, application No. 15/181,344, filed on Jun. 13, 2016, which is a continuation-in-part of application No. 13/844,611, filed on Mar. 15, 2013, now Pat. No. 9,428,955.

(60) Provisional application No. 62/175,275, filed on Jun. 13, 2015, provisional application No. 61/993,975, filed on May 15, 2014, provisional application No. 61/864,563, filed on Aug. 10, 2013.

(58) Field of Classification Search
USPC ..... 160/122, 133, 264, 121.1, 179
See application file for complete search history.

(56) References Cited

U.S. PATENT DOCUMENTS

| | | | | |
|---|---|---|---|---|
| 3,292,685 | A | 12/1966 | Clark | |
| 4,508,126 | A | 4/1985 | Everard | |
| 4,519,434 | A | 5/1985 | Forquer | |
| 4,720,647 | A | 1/1988 | Plumer | |
| 5,220,721 | A | 6/1993 | Thierry | |
| 5,323,831 | A | 6/1994 | Manthei | |
| 5,374,791 | A | 12/1994 | LeMarchand | |
| 5,429,558 | A | 7/1995 | Lagarde | |
| 6,006,811 | A | 12/1999 | Brutsaert | |
| 6,145,571 | A | 11/2000 | Snyder | |
| 9,428,955 | B2 | 8/2016 | Fleischman | |
| 2002/0020508 | A1* | 2/2002 | Welfonder | E06B 9/42 160/271 |
| 2002/0020580 | A1 | 2/2002 | Mukai et al. | |
| 2004/0016519 | A1* | 1/2004 | Welfonder | E06B 9/17046 160/178.1 R |
| 2006/0118356 | A1 | 6/2006 | Beeson et al. | |
| 2007/0193697 | A1* | 8/2007 | Horvath | E06L 39/54 160/23.1 |
| 2008/0016798 | A1 | 1/2008 | Miller | |
| 2008/0035281 | A1* | 2/2008 | Kirby | E06B 9/42 160/265 |
| 2009/0229767 | A1* | 9/2009 | Mullet | E06B 9/581 160/26 |
| 2011/0088317 | A1 | 4/2011 | Goldberg | |
| 2011/0100570 | A1* | 5/2011 | Licciardi Di Stefano | E06B 9/42 160/368.1 |
| 2012/0097346 | A1* | 4/2012 | Ng | E06V 9/388 160/264 |
| 2013/0048229 | A1 | 2/2013 | Dwarka | |
| 2013/0048231 | A1 | 2/2013 | Miller | |
| 2014/0041814 | A1 | 2/2014 | Roberts | |
| 2014/0262084 | A1 | 9/2014 | Fleischman | |
| 2015/0000849 | A1 | 1/2015 | Barnes et al. | |

FOREIGN PATENT DOCUMENTS

| | | | |
|---|---|---|---|
| EP | 2343418 | A1 | 7/2011 |
| EP | 2392747 | A2 | 12/2011 |
| EP | 2489811 | A1 | 8/2012 |
| EP | 3000958 | A1 | 3/2016 |
| WO | WO2014/145333 | | 9/2014 |
| WO | WO2015/176047 | | 11/2015 |

OTHER PUBLICATIONS

Written Opinion of the International Searching Authority, PCT/US2015/031258, Jacob Fleischman and Joel Klein, pp. 8, dated Sep. 16, 2016.

International Search Report, PCT/US2014/030073, Jacob Fleischman, pp. 2, dated Aug. 11, 2014.

Written Opinion of the International Searching Authority, PCT/US2014/030073, Jacob Fleischman, pp. 5, dated Aug. 11, 2014.

"Model Reinforced Barrier B-10R" Sound Seal—Industrial Noise Control Products.

"Sound Absorption" Accoustical Surfaces, Inc.

* cited by examiner

FIG. 16
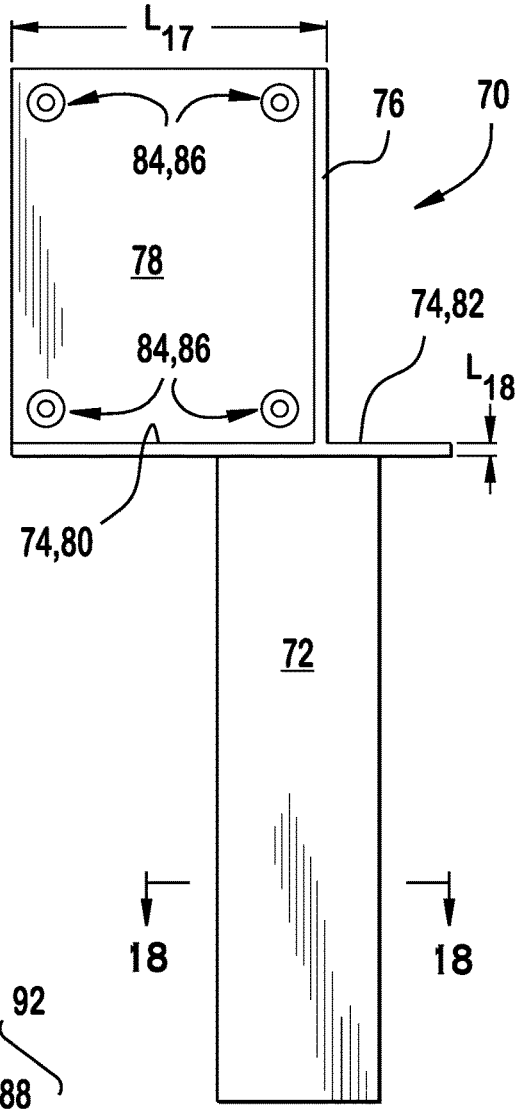
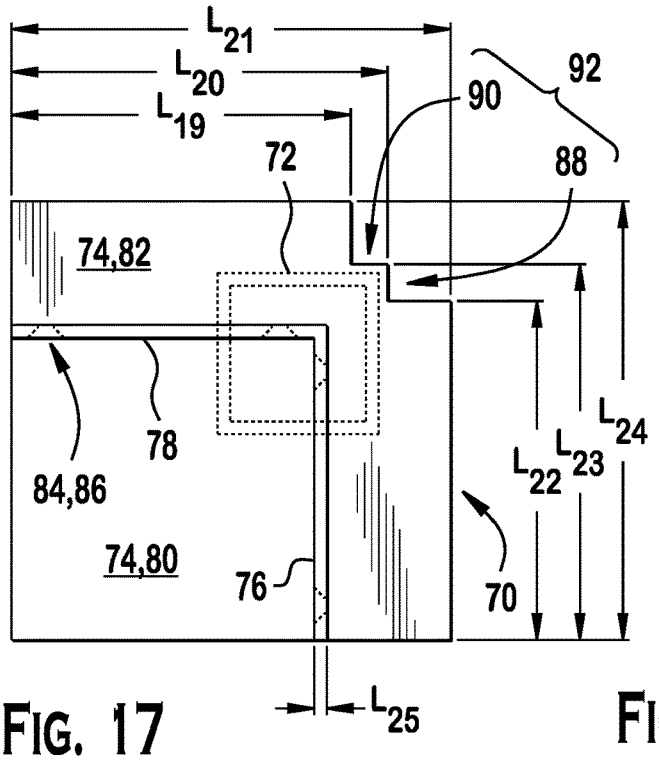
FIG. 17
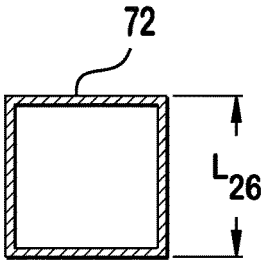
FIG. 18

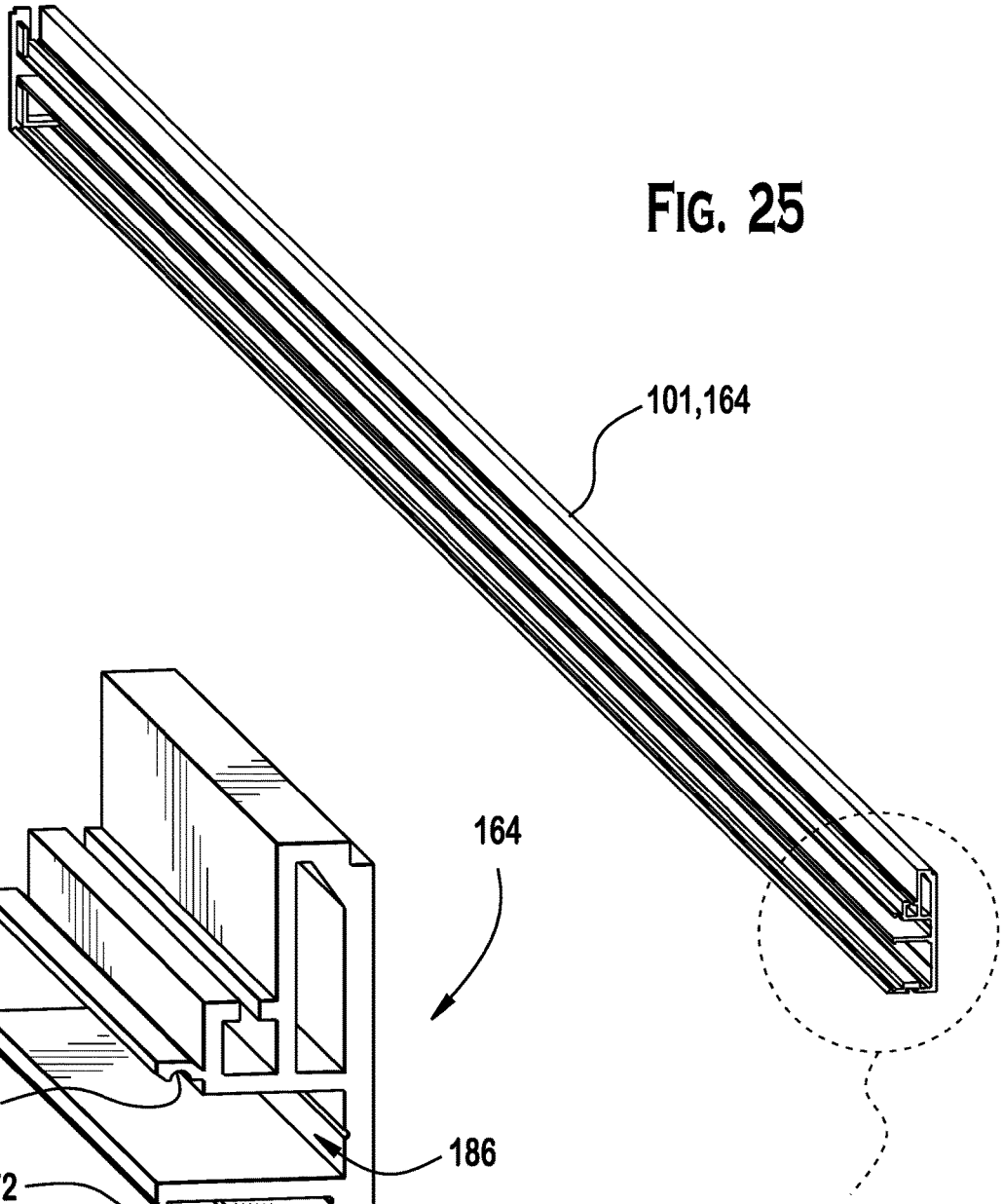
FIG. 25
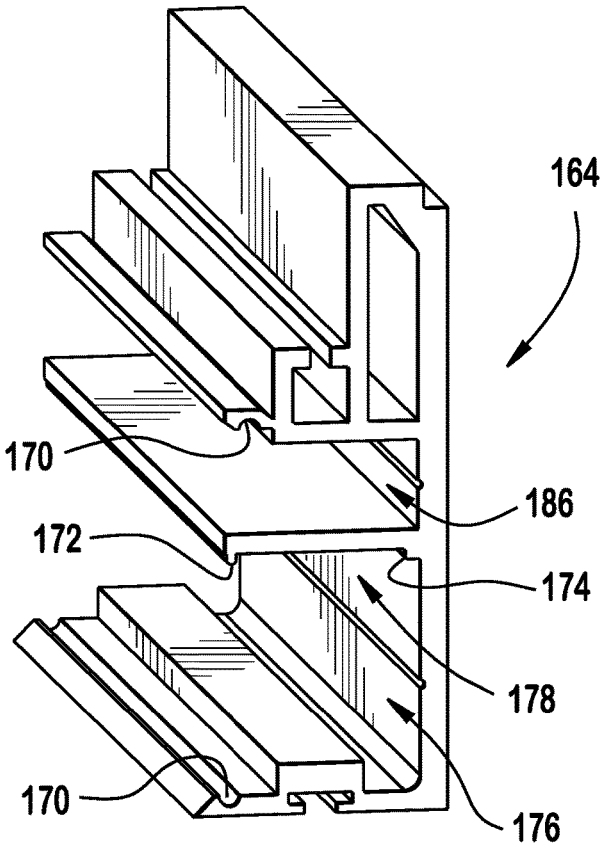
FIG. 26
FIG. 26

ROLL-UP WALL SYSTEM AND MODULAR COMPONENTS

CROSS REFERENCE TO RELATED APPLICATIONS

This application claims the benefit of U.S. patent application Ser. No. 62/175,275 filed Jun. 13, 2015. This application is a continuation-in-part of International Application No. PCT/US2015/031258 filed May 15, 2015, which claims the benefit of U.S. patent application Ser. No. 61/993,975 filed May 15, 2014. This application is a continuation-in-part of U.S. patent application Ser. No. 14/776,737 filed Sep. 14, 2015, which is a National Stage application under 35 U.S.C. 371 of International Application No. PCT/US2014/30073 with an international filing date of Mar. 15, 2014, which claims the benefit of U.S. patent application Ser. No. 61/864,563 filed Aug. 10, 2013. This application is a continuation-in-part of U.S. patent application Ser. No. 13/844,611 filed Mar. 13, 2013.

The entire disclosure of each of the International and U.S. patent applications identified in the preceding paragraph is incorporated by reference herein.

FIELD OF THE INVENTION

The present invention relates to a retractable wall system. More particularly, this invention relates to modular components for a roll-up wall system which may be used to divide a room or space, create an acoustic barrier, or provide a freestanding partition or structure.

BACKGROUND

A retractable wall may provide the ability to divide a room or provide enhanced privacy in the home or workplace. Still, a need exists for improved retractable wall system components that may be readily configured to divide an office space into separate work stations or conference rooms.

SUMMARY

Hence, the present disclosure is directed to a track for connecting a pair of flexible membrane barrier segments in a retractable wall system. The track may include an elongated member having a first longitudinal axis and a first cross-sectional profile perpendicular to the first longitudinal axis. The first cross-sectional profile may include a base surface and a latching surface. The latching surface may be spaced from the base surface and may include a first groove aligned with the first longitudinal axis, a second groove spaced from the first groove, a projecting element located between the first groove and the second groove, the projecting element being aligned with the first longitudinal axis. The projecting element may include a first wall which extends away from the latching surface, a second wall adjacent to the first wall, a third wall adjacent to the second wall, the second and third wall defining a ledge between the second wall and the third wall. The latching surface further may include a fourth wall extending from the latching surface toward the third wall, the first wall, second wall, third wall and fourth wall bounding an interior channel, the third wall and the fourth wall defining a seat and a slot which connects the seat to the interior channel. The latching surface may further include a hooking element spaced from the projecting element, and a guide surface disposed between the projecting element and the hooking element.

DESCRIPTION OF THE DRAWINGS

In the accompanying drawings, which form a part of the specification and are to be read in conjunction therewith and in which like reference numerals (or designations) are used to indicate like parts in the various views:

FIG. 16 is a right side view of the corner bracket of FIG. 12;

FIG. 17 is a top view of the corner bracket of FIG. 12;

FIG. 18 is a cross-sectional view along line 18-18 of FIG. 12;

FIG. 22 is detail view of one end of the center track of FIG. 20;

FIG. 25 is a perspective view of a base part of an exemplary horizontal track of FIG. 20;

FIG. 26 is a detail view of one end of the base part of the horizontal track of FIG. 26;

DESCRIPTION

Figure 1:
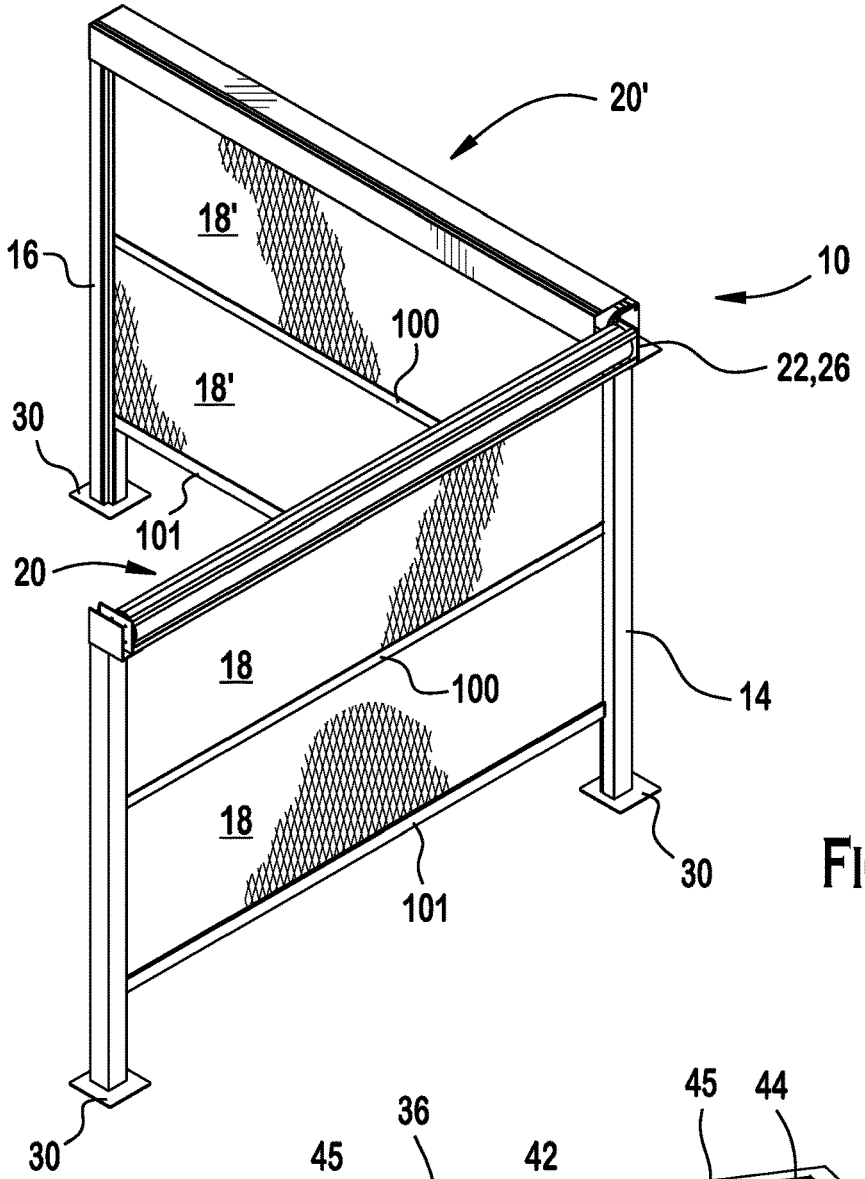
FIG. 1 is a perspective view of a modular wall system in accordance with the present invention.

FIG. 1 depicts an exemplary modular roll-up wall system 10. The modular wall system may include a first vertical post 12, a second vertical post 14, and a third vertical post 16. Disposed between the first and second vertical posts is a screen (or flexible barrier material) 18. The screen is set up on a roller system 20. The roller system 20 may be mounted between two brackets. A side bracket 24 may be positioned in the first vertical post 12 and a corner bracket 26 may be positioned in the second vertical post 14. A first roller system may be mounted between the first side bracket and corner bracket. A second roller assembly may be mounted between the corner bracket and the third vertical post. The third vertical post 26 may include another side bracket. Each vertical post may be disposed over a base plate 30. The base plate (FIGS. 29-30) may include a wider flat surface 32 and a projection 34 which is configured and dimensioned to be disposed within the core 36 of the vertical post. Preferably the base plate is made from steel so that it provides a heavy base to provide stability for the partition.

Retractable wall systems are disclosed in US published patent Application No. 2014/0262084, which is incorporated herein by reference. Also, retractable wall systems and adaptor components are disclosed in Intl. Application No. PCT/US2014/030073 filed Mar. 15, 2014, which published as Intl. Application No. WO 2014/145333, which is incorporated herein by reference.

Figure 2:
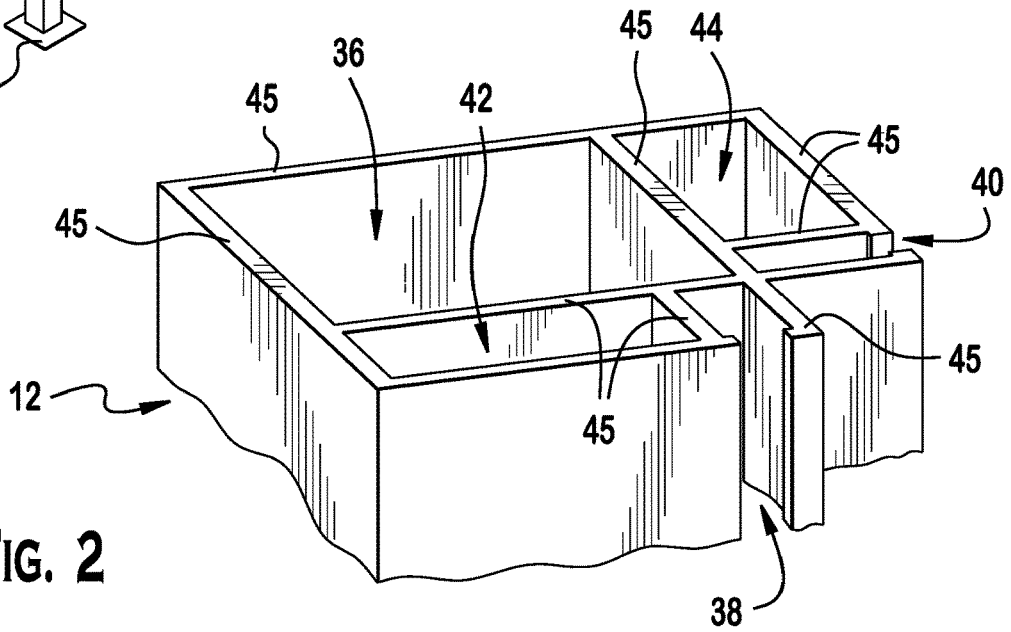
FIG. 2 is a partial perspective view of one end of an exemplary vertical post of FIG. 1.

Referring to FIG. 2, a vertical post 12 may include a core 36, two vertical track portions, and two ducts. These features may be defined by interconnected walls. The walls may include one or more openings that form a passage through the walls of the vertical track. The openings may be used to pass electrical cable or receive fasteners. In one embodiment, the vertical post may be formed from an alloy. Preferably, an aluminum alloy. In another embodiment, the vertical post made be formed from wood. In yet another embodiment, the vertical post may be formed from a reinforced polymer material. The vertical post may be part of larger structure.

Figure 3:
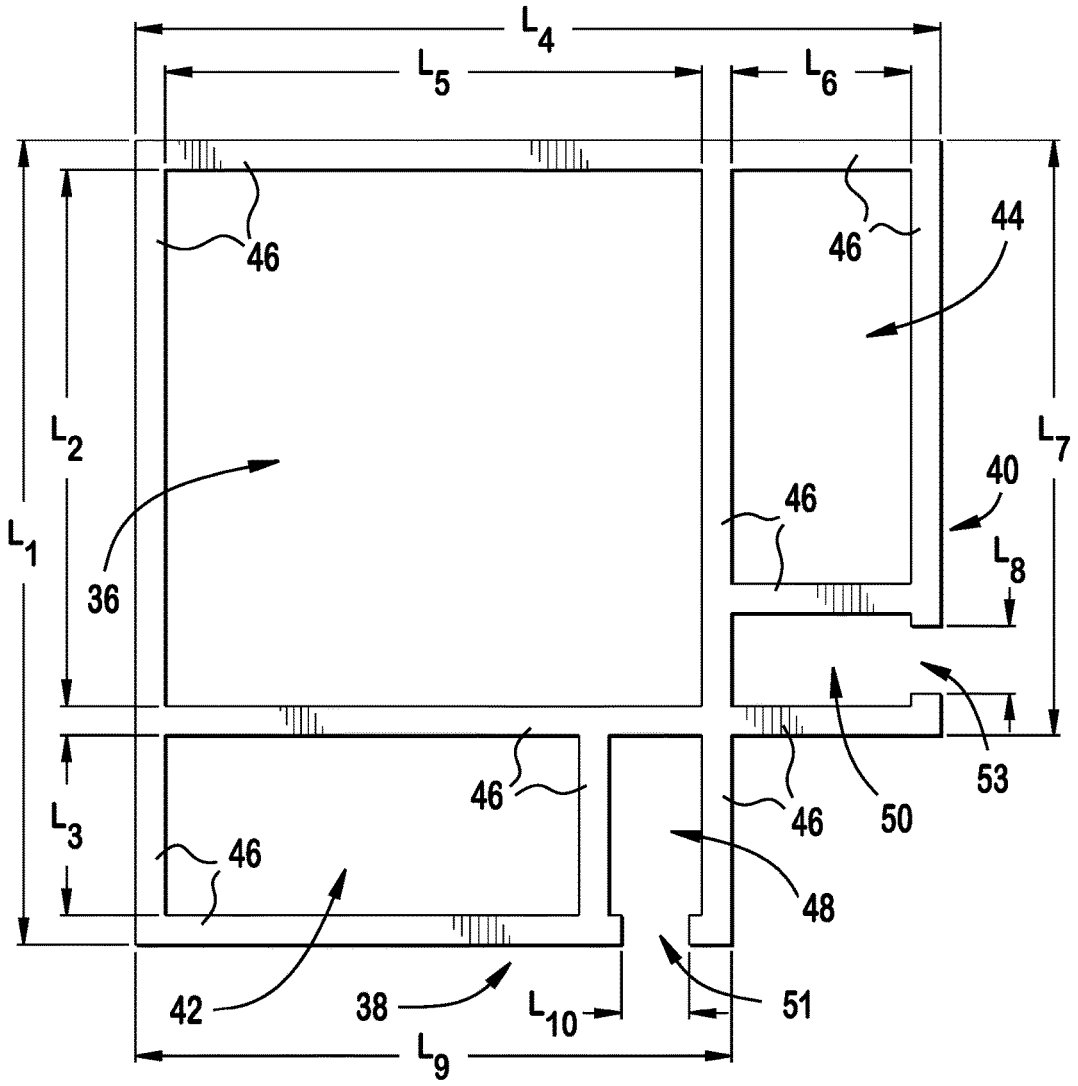
FIG. 3 is a top view of the vertical post of FIG. 2.

FIG. 3 depicts top view (or cross-sectional view through the longitudinal axis) of a typical vertical post. The vertical post 12 may include a core 36. The inner dimensions of the core may be approximately 2.5"×2.5". Additionally, the vertical post 12 may include two exterior track portions 38, 40. Each exterior track portion 38, 40 may include a closed rectangular section (or duct) 42, 44 and a track 48, 50 which may be formed by smaller and generally rectangular section. The smaller rectangular section 48, 50 may include a slot 51, 53 which opens to an outside sidewall of the vertical post. Exemplary dimensions of these features are shown below in Table I. The slot 51, 53 of each respective smaller rectangular section 48, 50 may be sized and configured to receive (or pass) a sheet of flexible barrier material that forms the retractable wall, screen, or partition.

TABLE I

Exemplary Dimensions of Vertical Post

| Dimension | (Inches) |
|---|---|
| L1 | 3.75 |
| L2 | 2.50 |
| L3 | 0.97 |
| L4 | 3.75 |
| L5 | 2.50 |
| L6 | 0.97 |
| L7 | 2.78 |
| L8 | 0.31 |
| L9 | 2.78 |
| L10 | 0.31 |

The smaller rectangular section 48, 50 may also receive an inner sleeve that further constricts the size of the slot 51, 53. In this fashion, flexible barrier materials of different thicknesses and construction may be used to form the retractable wall or partition. For example, the slot 51, 53 without an inner sleeve may be used for a flexible barrier material formed from mass loaded vinyl. In another example, without limitation, the flexible barrier material may be a vinyl fabric that is capable of receiving a print design. Alternatively, the flexible barrier material may be a fabric (e.g., cotton, polyester, or rayon). An inner sleeve may be used with the vinyl fabric or fabric because these materials may be substantially thinner than a mass loaded vinyl barrier material.

Figure 4:
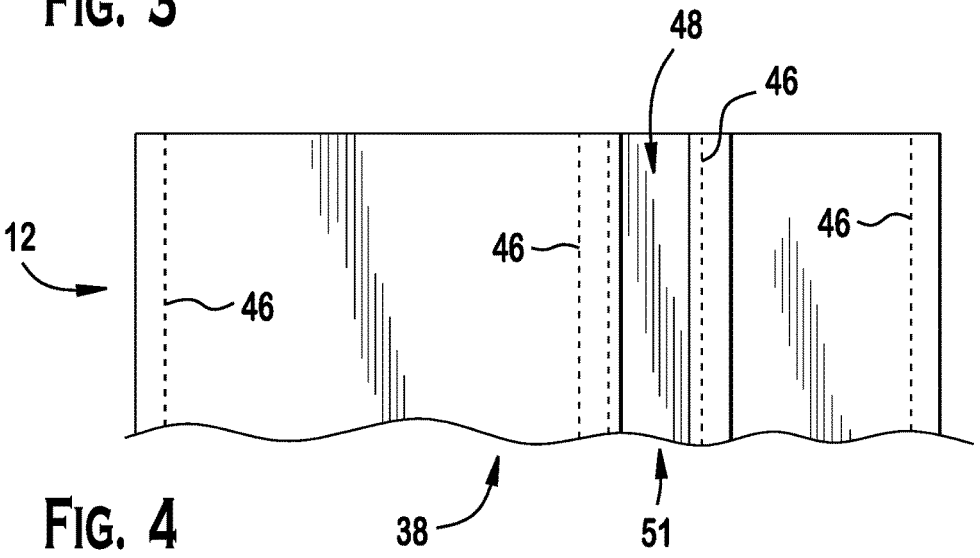
FIG. 4 is an elevation view of the vertical post of FIG. 3.

FIG. 4 shows the vertical post 12 of FIG. in a front elevation. In this view the slot 51 is visibly narrower than the distance between the opposing side walls 46 of track 48.

Figure 5:
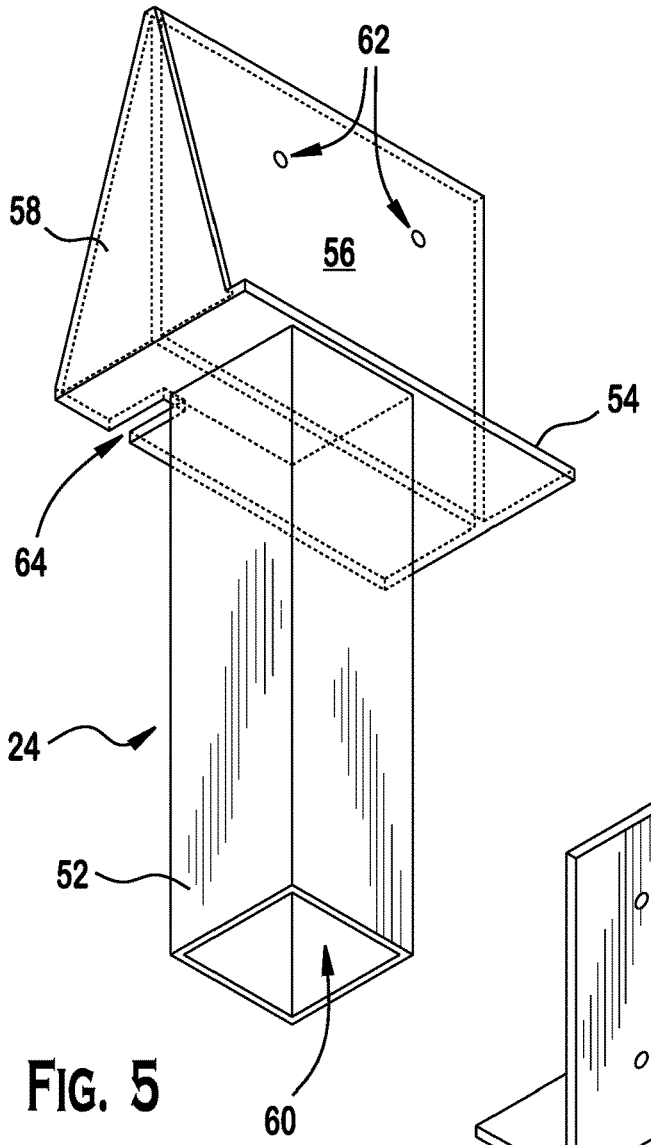
FIG. 5 is a bottom rear (exterior) perspective view of a side bracket of FIG. 1.
Figure 6:
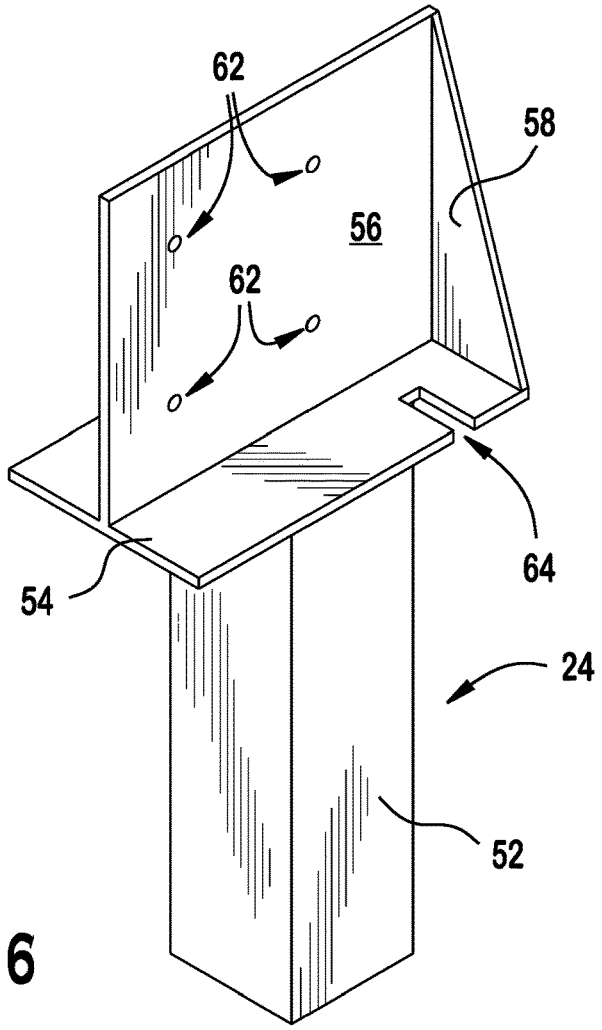
FIG. 6 is a top, front (interior) perspective view of the side bracket of FIG. 5.
Figure 7:
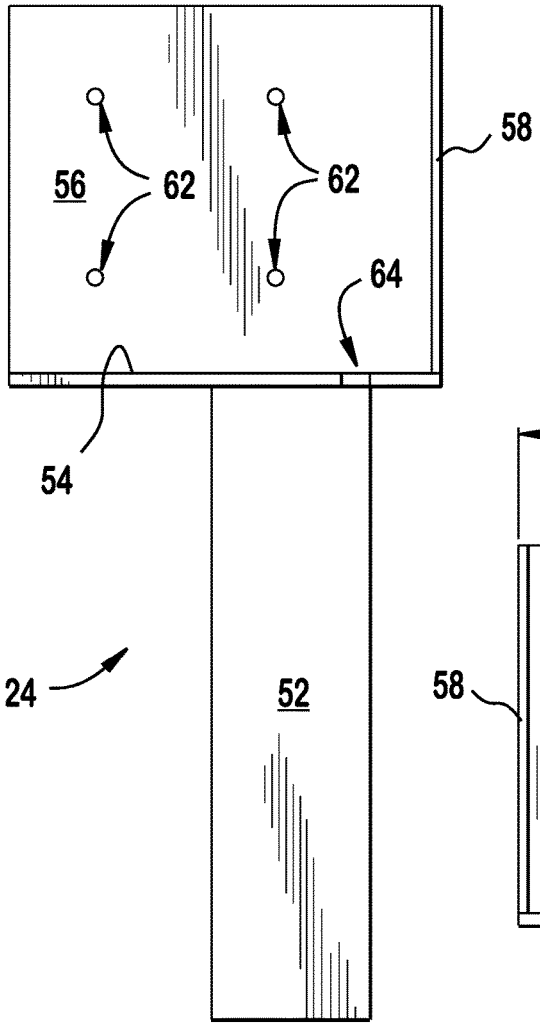
FIG. 7 is a front (interior) view of the side bracket of FIG. 5.

Referring to FIGS. 5 and 6, a side bracket 24 for the modular wall system may include a post 52, a platform 54, a bracket 56, and a side wall 58. The post may be a hollow member with an open channel 60. The side bracket 24 may include one or more mounting holes 2 for securing a motor bracket or other equipment. The platform 54 may include a slot 64 which may be configured and dimensioned to receive flexible barrier material 18 from the roller assembly 20. FIG. 7 depicts a front view of the side bracket 24. In this view, the bracket 56, side wall 58, platform 54 and the slot 64 in the platform are visible. The side bracket may be dimensioned as shown below in Table II.

TABLE II

Exemplary Dimensions of Side Bracket

| Dimension | (Inches) |
|---|---|
| L11 | 6.80 |
| L12 | 6.00 |
| L13 | 10.00 |

Figure 8:
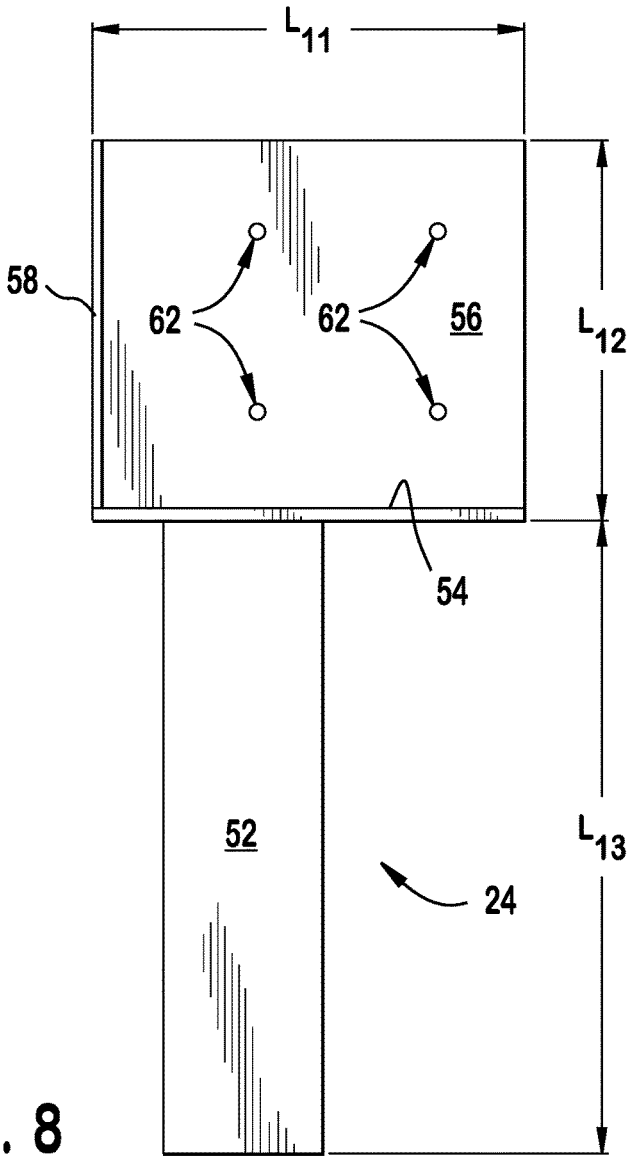
FIG. 8 is a rear (exterior) view of the side bracket of FIG. 5.
Figure 9:
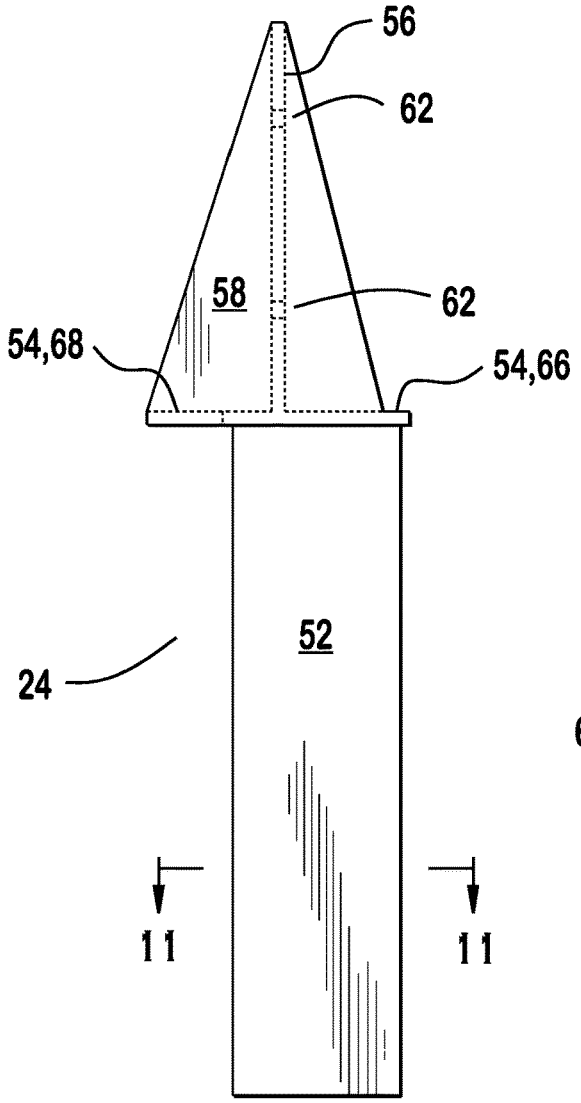
FIG. 9 is a side view of the side bracket of FIG. 5.
Figure 10:
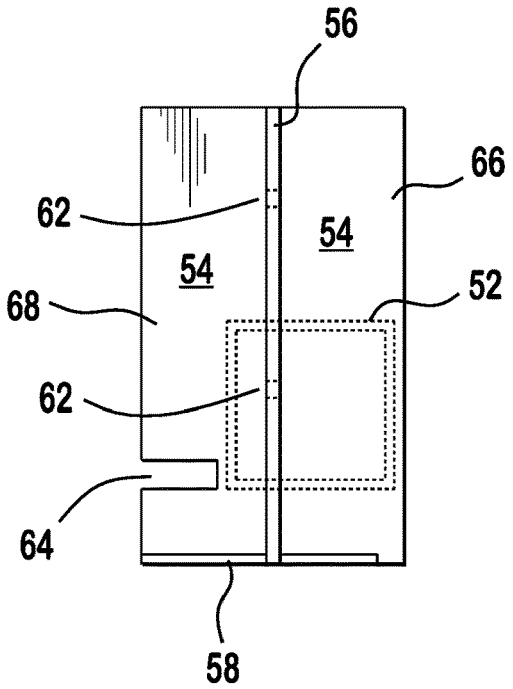
FIG. 10 is a top view of the side bracket of FIG. 5.
Figure 11:
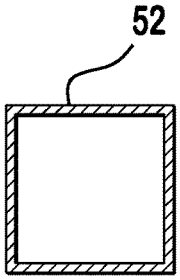
FIG. 11 is a cross-sectional view along line 11-11 of FIG. 5.

FIG. 8 shows a rear view of the side bracket. The mounting holes 62 may be positioned as indicated in the drawings, however, they may be positioned to match with any given motor bracket. FIG. 9 is a side view of the side bracket. The side wall 58 may form a general triangular shape, which may provide stability for the bracket. FIG. 10 is a top view of the side bracket 24. The platform may include a rear deck 66 and a front deck 68. The slot 64 may be situated on the front deck 68. FIG. 11 is a cross sectional view along line 11-11 of FIG. 9. As shown in FIG. 11, the cross section of the post 52 may be a hollow member of square shape. The post, however, may be solid or have rectangular or some other shape (e.g., hexagonal). In the exemplary embodiment, the post is 2.5 inches on each side. Note that the inner dimension of the core 36 of the vertical post is 2.5 inches, such that the post 52 of the side bracket 24 may be telescopically received in the core 36 of the vertical post.

Figure 12:
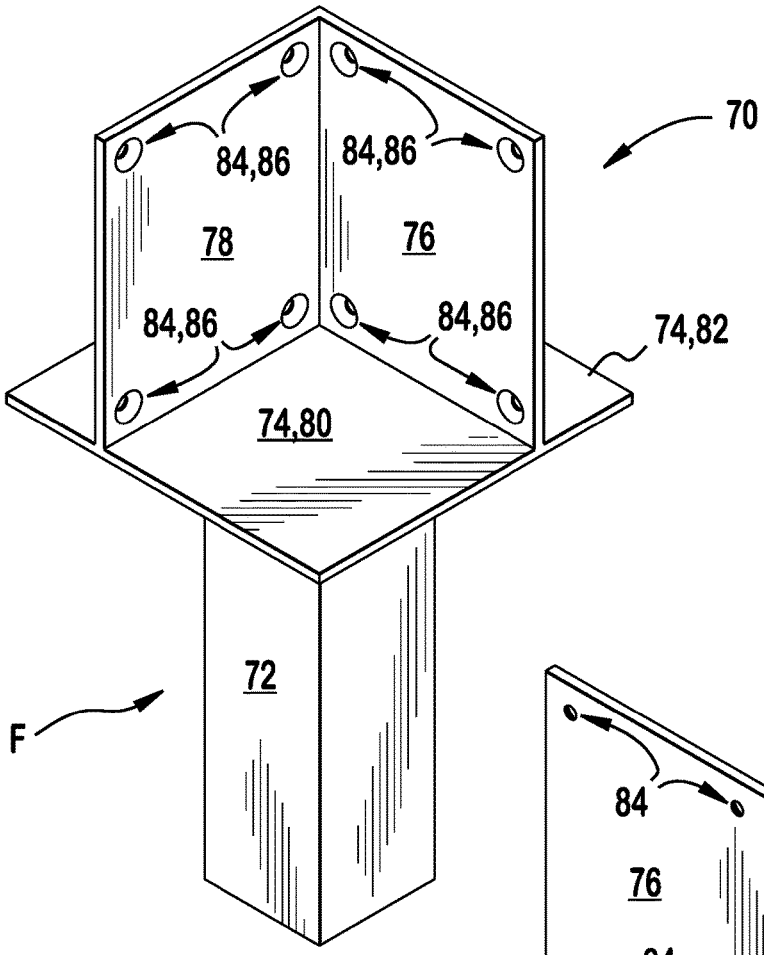
FIG. 12 is a top exterior perspective view of a corner bracket of FIG. 1.
Figure 13:
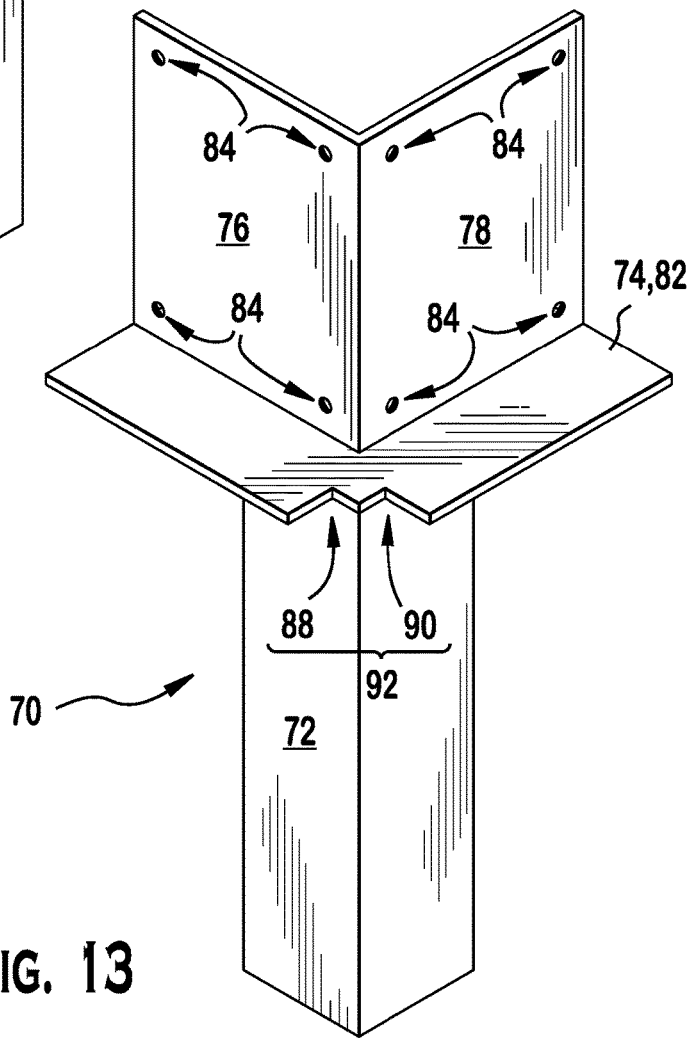
FIG. 13 is a top interior perspective view of a corner bracket of FIG. 12.
Figure 14:
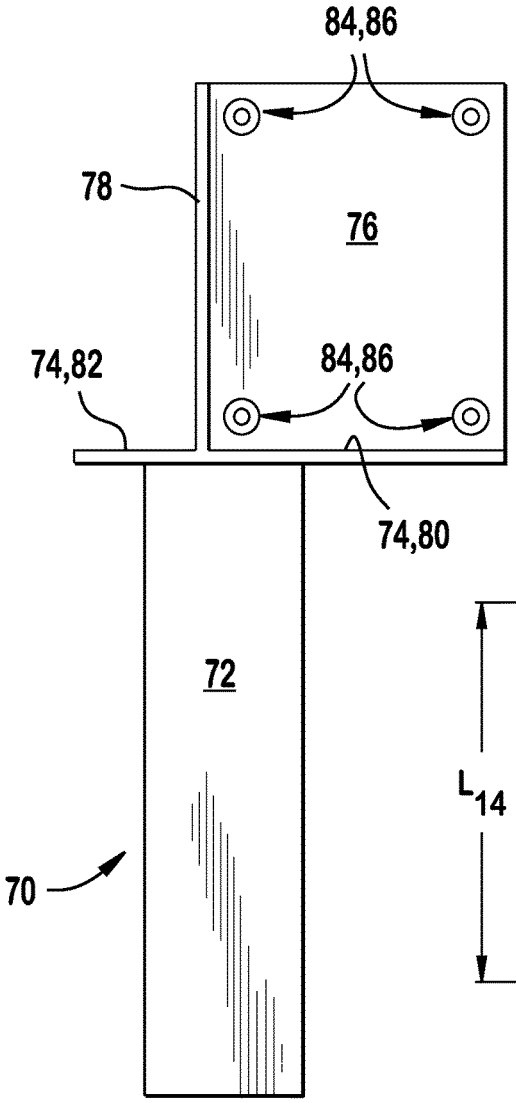
FIG. 14 is a front view of the corner bracket of FIG. 12.
Figure 15:
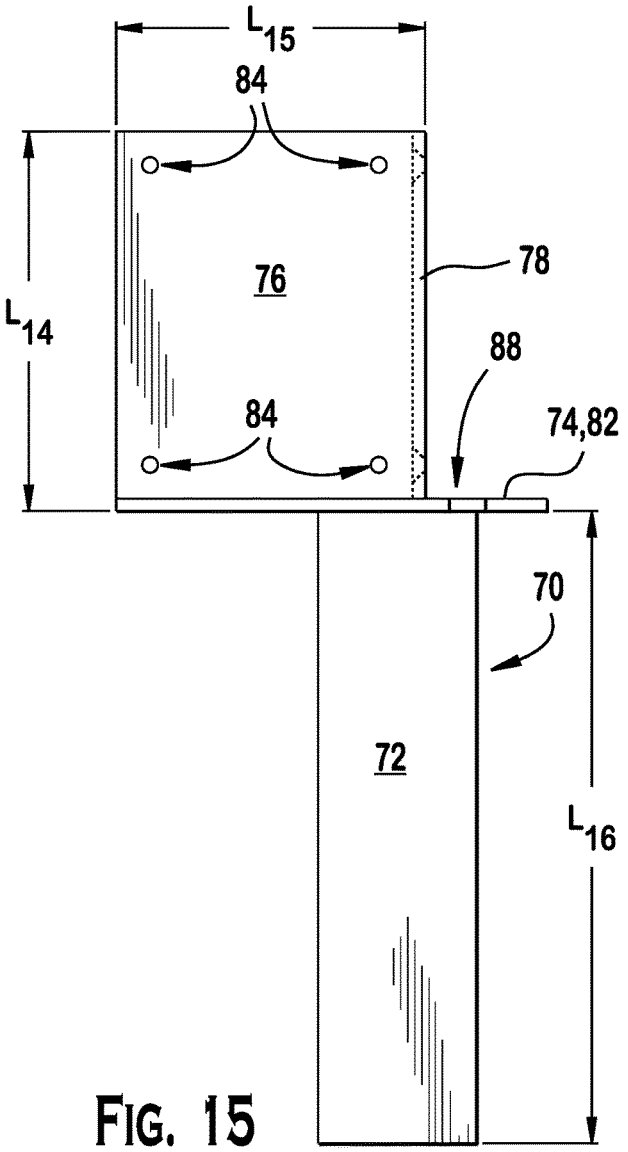
FIG. 15 is a rear side view of the corner bracket of FIG. 12.

FIG. 12 is a perspective view of a corner bracket 70. The corner bracket 70 may include a post 72, a platform 74, a first bracket 76, and a second bracket 78. The platform 74 may include an outer deck 80 and an inner deck 82. The first bracket 76 and the second bracket 78 may each include one or more mounting holes 84. The mounting holes may be counter-sunk 86 on one side of the brackets. The left and right bracket may form an angle (e.g., 90° angle). FIG. 13 shows another perspective view of the corner bracket 70. The first side inner deck and the second side inner deck may each include a notch 88, 90. The notches 88, 90 may abut each other to form a symmetrically stepped profile 92. Each notch 88, 90 may be sized and positioned to allow the screen or flexible barrier material to hang vertically from a roller assembly. FIG. 14 is a front view of the corner bracket 70. FIG. 15 is a rear view of the corner bracket 70. FIG. 16 is a right side view of the corner bracket. In this view, the second bracket 78 and mounting holes 84 are shown. FIG. 17 is a top view of the corner bracket 70. Exemplary dimensions for the corner bracket are shown in Table III (below).

TABLE III

Exemplary Dimensions of Corner Bracket

| Dimension | (Inches) |
|---|---|
| L14 | 6.00 |
| L15 | 4.88 |
| L16 | 10.00 |
| L17 | 17.00 |
| L18 | 0.20 |
| L19, L22 | 5.25 |
| L20, L23 | 5.82 |
| L21, L24 | 6.80 |
| L25 | 0.20 |
| L26 | 2.50 |

As shown in FIG. 17, the rear deck may include a W-shaped step 92. The W-shaped step may allow the flexible barrier material to spool off the roller and into the slot in the vertical post beneath the corner bracket. FIG. 18 is a cross-sectional view of FIG. 16 along Line 18-18. Exemplary dimensions for a square post are shown in Table III. As described above in connection with the post for the side bracket, the post 72 for the corner bracket 70 may be configured and dimensioned to be received in the core 36 of the vertical post. The post 72 may have different cross-sectional profiles as well (e.g., rectangular).

Figure 19:
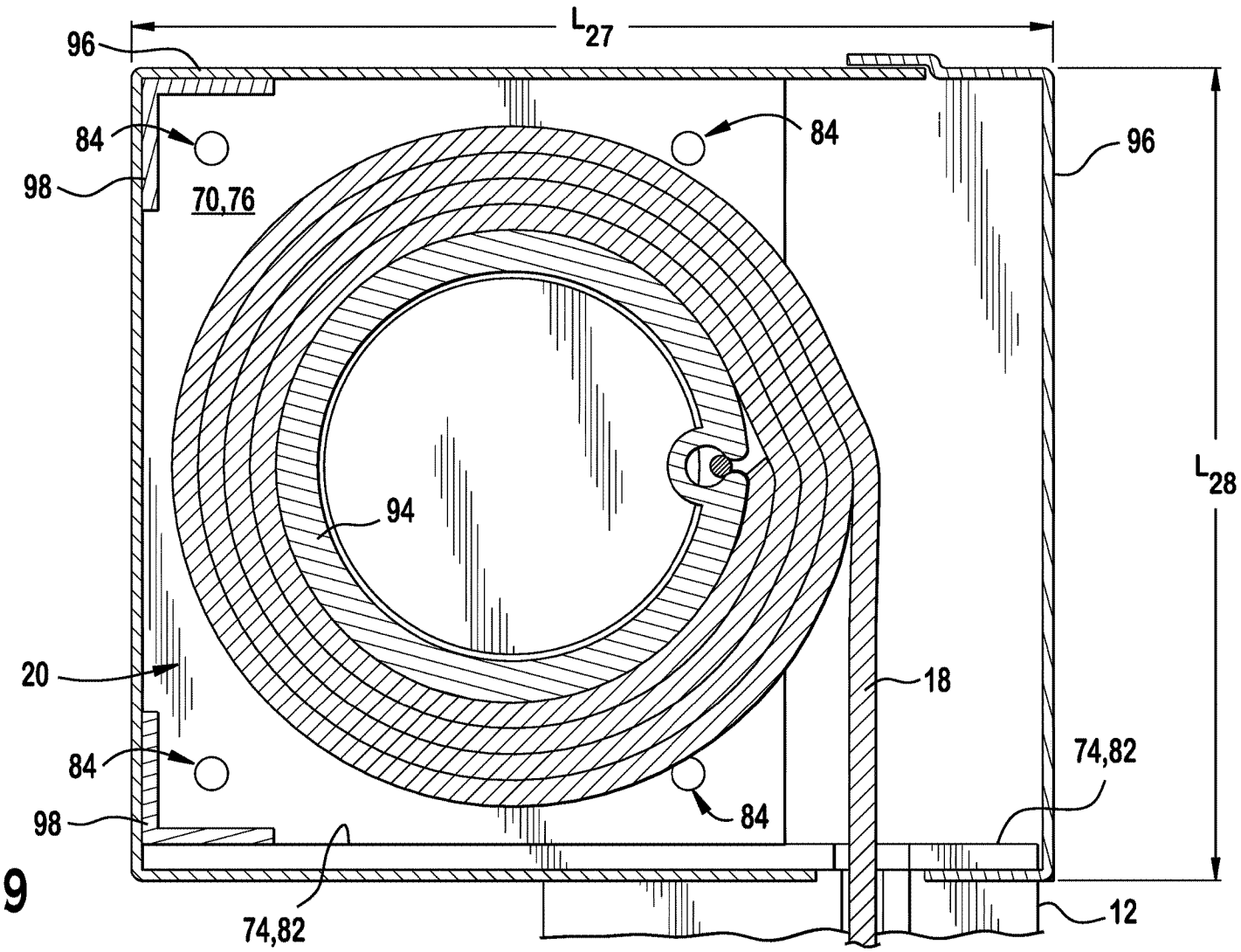
FIG. 19 is a cross-sectional view of an exemplary roller assembly and drum cover of FIG. 1.

As shown in FIG. 19, the roller assembly 20 may be secured to the corner bracket 70, 76, which in turn may be disposed in the large rectangular section 36 of the vertical post 12. The roller assembly 20 may include a motor bracket that is secured to the side bracket 76 and a tube 94 that receives the flexible barrier material 18. The flexible barrier material may exit the roller assembly through the notch in the corner bracket (or the slot in the side bracket) and continue into the slot 38 of the vertical post 12. The drum cover 96 may be mounted onto the corner bracket 70 (or side bracket 24) and two 90° channel iron 98 members. The drum cover 96 may be formed from sheet metal or other suitable materials. Exemplary dimensions for the screen drum cover are shown in inches in Table IV.

TABLE IV

Exemplary Dimensions of Screen Drum Cover

| Dimension | (Inches) |
|---|---|
| L27 | 6.99 |
| L28 | 6.16 |

Figure 20:
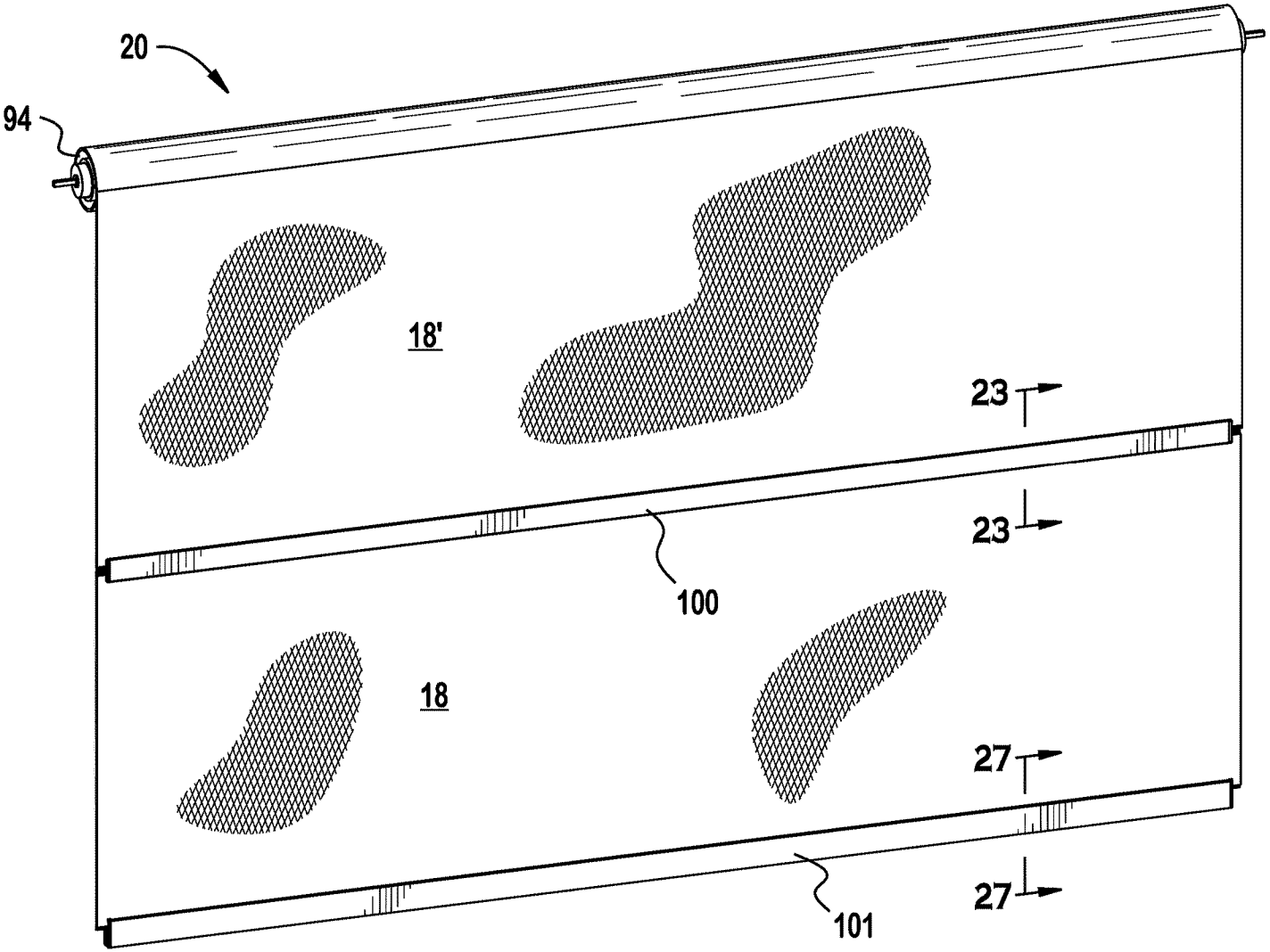
FIG. 20 is a perspective view of the exemplary roller assembly of FIG. 1.

FIG. 20 is a perspective view of a roller assembly 20 of the modular wall system of FIG. 1. The roller assembly may include a tube 94 and a flexible membrane barrier 18 connected to the tube. The flexible membrane barrier 18 may be a sheet of mass loaded vinyl. The flexible membrane barrier may be constructed from more than one sheet. For example, two sheets of mass loaded vinyl may be spliced together to form a continuous sheet. The two sheets of mass loaded vinyl may be spliced together with a specially adapted connection piece, or center track 100. A center track 100 suitable for joining two sheets of mass loaded vinyl are disclosed in U.S. Provisional Application No. 61/993,975 filed May 15, 2014 entitled Retractable Wall System and Roll-up Acoustic Barrier, co-pending Intl. Application No. PCT/US15/31258, filed Mar. 15, 2015, which is incorporated herein by reference. The lower segment of flexible barrier material may be connected to a horizontal track 101.

Figure 21:
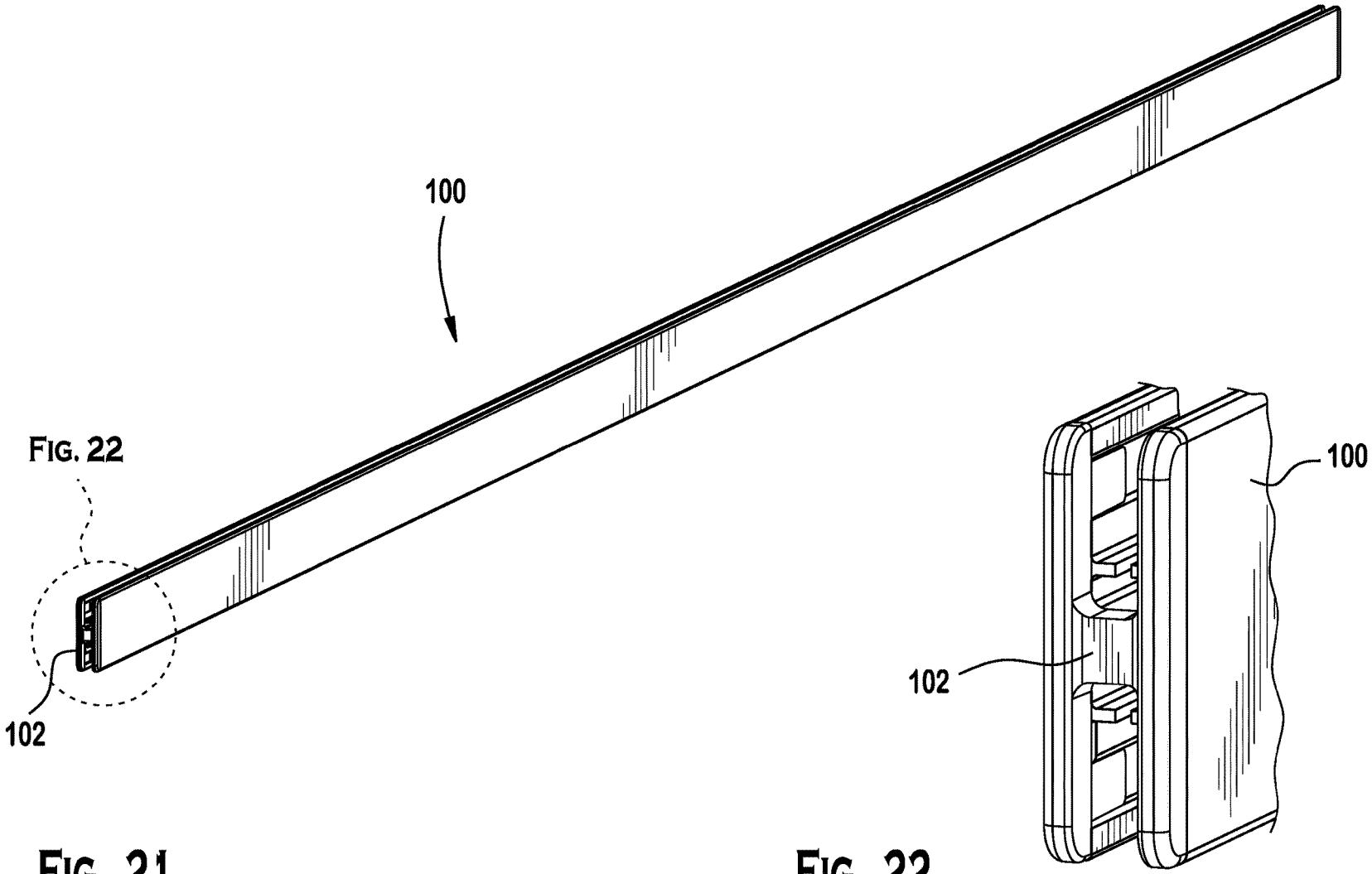
FIG. 21 is a perspective view of the center track of FIG. 20.
Figure 23:
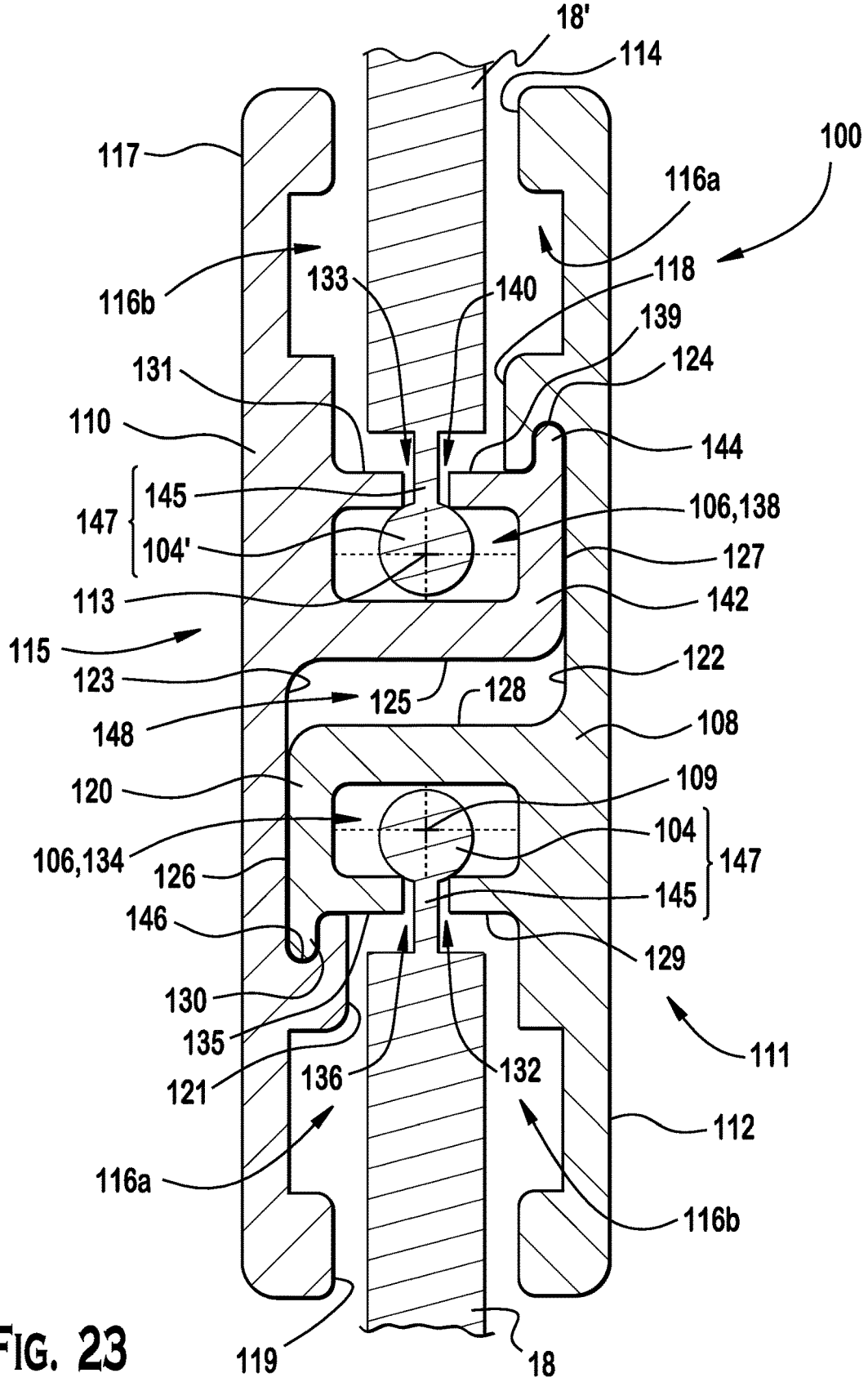
FIG. 23 is a cross-sectional view of the center track of FIG. 20 along line 23-23.

Referring to FIG. 21 and FIG. 22, the exemplary center track 100 may include an end piece 102. Referring to FIG. 23, each sheet of flexible membrane barrier (e.g., mass loaded vinyl) 18 may include a zipper securing element (or similar structure) 104 that is confined within a channel 106 of the connection piece. In this fashion, the center track (or connection piece) 100 may hold the zippers 147 in alignment and secure the sheets of flexible membrane barrier (e.g., mass loaded vinyl) into the connection piece to form a single sheet of flexible barrier material. The connection piece 100 may be formed from two identical halves. For example, the center track 100 may include two track components 108, 110. One track component 110 may be secured to an upper segment 18' of flexible barrier material which may be connected to the tube 94 of the roller assembly 20, and another track component 108 may be secured to a lower segment 18 of flexible barrier material. The two track components 108, 110 may share a common profile. The track components may be formed from the same materials and finishes as the vertical posts 12 (e.g., aluminum alloy or reinforced polymer material).

Figure 24:
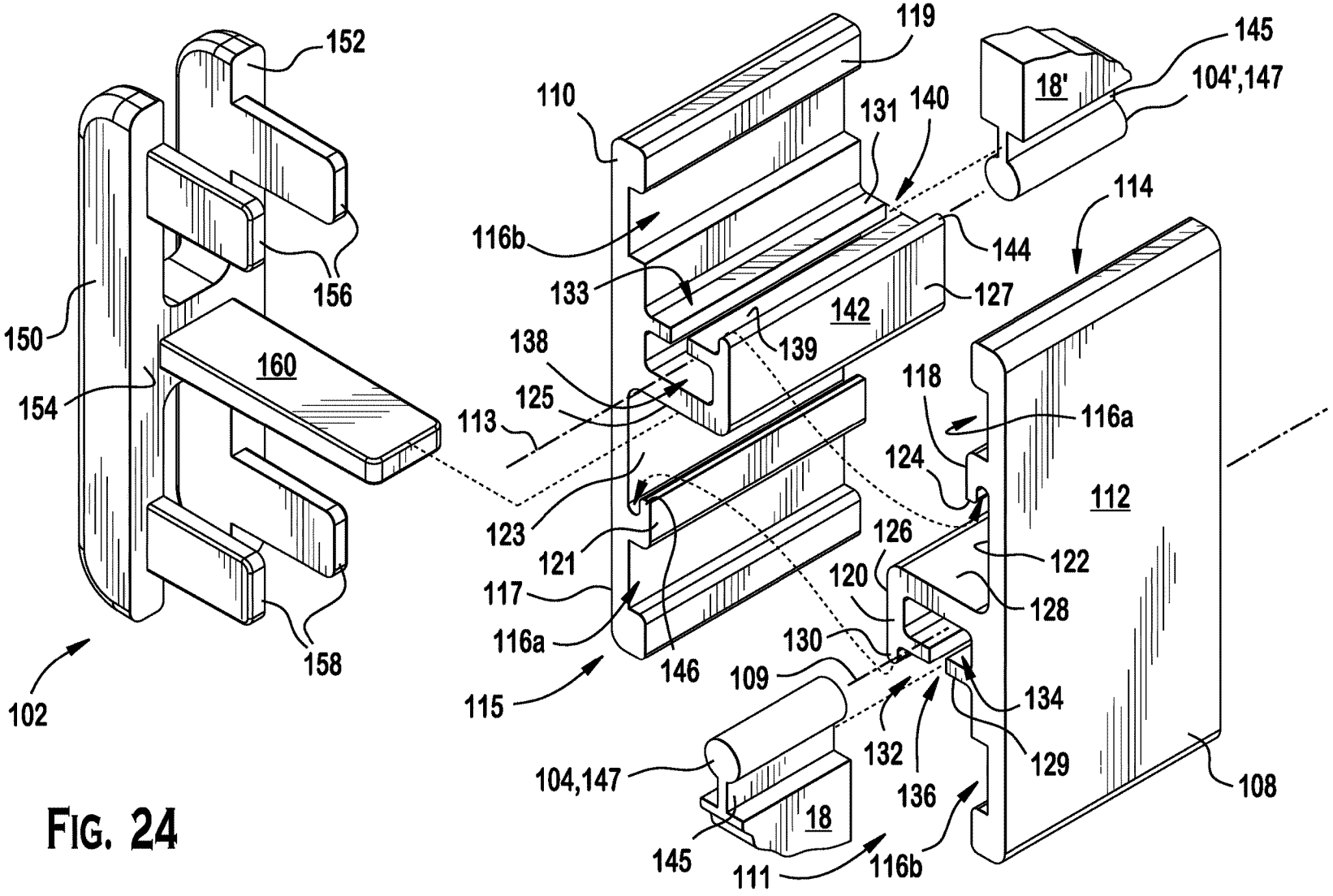
FIG. 24 is an exploded perspective view of FIG. 23.

As shown in FIG. 24, one track component 108 may have a generally flat outer surface 112. Additionally, the inner surface 114 may include two grooves 116*a*, 116*b* a hooking element 118, and a projecting element 120. The hooking element 118 may include a guide surface 122 and a curved projection 124, which may curve toward the projecting element. The projecting element 120 may include a generally flat side surface 126 which is generally parallel to the outer surface 112. The projecting element 120 may further include another generally flat side surface 128 which is disposed generally perpendicular with the outer surface 112. Also, the projecting element 120 may include a rail (or ledge) 130, a seat 132, and a rectangular passage 134 disposed within the projecting element. The projecting element further may include a slot 136 which connects the seat and the rectangular passage.

The securing elements 104 of the zipper 147 located at the top of the lower flexible barrier material segment 18 may be slid into the passage 134 of the lower track component 108 with the ribbon portion 145 extending through the slot 136 of the lower track component's projecting element 120. Similarly, the securing elements 104' of the zipper 147 at the bottom of the upper flexible barrier material segment 18' may be slid into the passage 138 of the upper track component 110 with the ribbon portion 145 of the zipper extending through the slot 140 of the upper track component's projecting element 142.

Referring to FIG. 23, the top track component 110 and the bottom track component 108 may move apart such that the rail 144 of the top track component may interlock with the curved projection 124 of the bottom track component 108, and the rail 130 of the bottom track component 108 may interlock with the curved projection 146 of the top track component 110. In this locked configuration, a gap 148 may exist between the top projecting element 142 and the bottom projecting element 120.

Referring to FIG. 24, a locking end cap 102 may be connected to both ends of the interlocked track components 108, 110 to secure the central track 100 in the locked configuration. The locking cap 102 may include two elongated members 150, 152. The two elongated members may be spaced from each other. The elongated members may be connected by a cross member 154. The cross member 154 may connect the two elongated members near the middle of each elongated member. Each elongated member 150, 152 further may include two projections 156, 158. The projections may extend in the same general direction. The cross member 154 may be situated between two projections on the same elongated member. The projections may be of the same size, orientation, and shape. The locking end cap 102 further may include a stem 160. The stem 160 may extend from the cross member 154. The stem may be larger than the projections 156, 158.

Referring to FIG. 23 and FIG. 24, the four projections 156, 158 and stem 160 may be configured and dimensioned to be received between the two track components 108, 110. One projection 156, 158 may be received in each of the grooves 116*a*, 116*b* that are located on the inner surfaces of the track components 108, 110. The stem 160 may be configured and dimensioned to be received in the gap 148 between the top projecting element 142 and the bottom projecting element 120. Although the projections may be pressed inwardly slightly when inserted into the track assembly so as to provide a tight fit, the projections preferably are sufficiently rigid and strong so as to securely block lateral, relative movement of the two track components. Moreover, the stem 160 may securely block relative, vertical movement of the two track components. Thus, the locking end cap 102 may splice two segments 18, 18' of flexible barrier material together, as well as securely lock the upper track component 110 and the lower track component 108 together.

As shown in FIG. 24, a track 100 for connecting a pair of flexible membrane barrier segments includes a first track component 108 having a first longitudinal axis 109 and a first cross-sectional profile 111 perpendicular to the first longitudinal axis. The first cross-sectional profile includes a base surface 112 and a latching surface 114 that is spaced from the base surface. The latching surface includes a first groove 116*a* aligned with the first longitudinal axis, a second groove 116*b* spaced from the first groove, and a projecting element 120 located between the first groove and the second groove. The projecting element is aligned with the first longitudinal axis. The projecting element including a first wall 128 which extends away from the latching surface, a second wall 126 adjacent to the first wall, a third wall 135 adjacent to the second wall, the second and third wall defining a ledge 130 between the second wall and the third wall, and a fourth wall 129 extending from the latching surface toward the third wall. The first wall, second wall, third wall and fourth wall bounding a first passage 134. The third wall and the fourth wall define a seat 132 and a slot 136 which connects the seat to the first passage. The first cross-sectional profile further includes a hooking element 118 spaced from the projecting element, and a guide surface 122 disposed between the projecting element and the hooking element.

Referring to FIG. 23, a second track component 110 is interlocked with the first track component 108. The first track component 108 and the second track component 110 share a common profile 111, 115. The second track component includes a second longitudinal axis 113 and a second cross-sectional profile 115 perpendicular to the second longitudinal axis. The second cross-sectional profile includes a second base surface 117 and a second latching surface 119 that is spaced from the second base surface. The second latching surface includes a third groove 116*a* aligned with the second longitudinal axis, a fourth groove 116*b* spaced from the third groove, and a second projecting element 142 located between the third groove and the fourth groove.

As shown in FIG. 24, the track component 110 includes a second hooking element 121 spaced from the second projecting element and a second guide surface 123 disposed between the second projecting element and the second hooking element. The projecting element 120 mates with the second hooking element 121, and the second projecting element 142 mates with the hooking element 118. The second projecting element 142 further includes a fifth wall 125 which extends away from the second latching surface 119, a sixth wall 127 adjacent to the fifth wall, and a seventh wall 139 adjacent to the sixth wall. The sixth wall and seventh wall define a second ledge 144. An eighth wall 131 extends from the second latching surface toward the seventh wall. The fifth wall, sixth wall, seventh wall and eighth wall bound a second passage 138. The seventh wall and the eighth wall defining a second seat 133 and a second slot 140 which connects the second seat 133 to the second passage 138.

Figure 27:
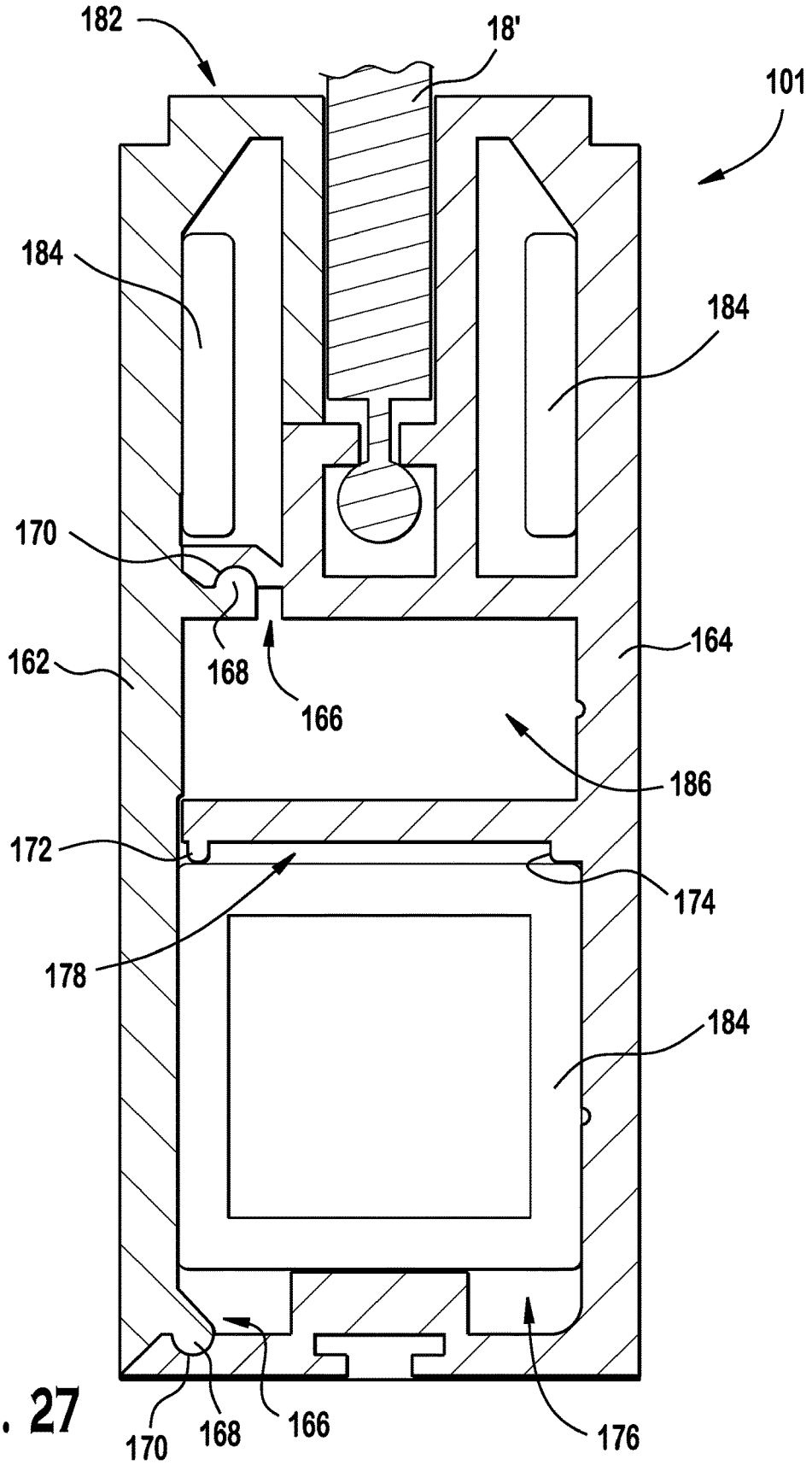
FIG. 27 is a cross-sectional view of the horizontal track of FIG. 20 along line 27-27.

Referring to FIG. 27, the horizontal track 101 may have a cross-sectional profile that includes a first portion 162 which may be removable, and may form a cover. The removable portion (e.g., Part 1) 162 may be secured to a receiving (or base) portion 164 (e.g., Part 2) with one or more snap fitting(s) 166. In an exemplary embodiment, the snap fitting 166 may be a mechanical joint system where part-to-part attachment is accomplished with locating and locking features that are homogenous with one or the other of the components being joined. Joining may require the (flexible) locking features to move aside for engagement with the mating part, followed by return of the locking feature toward its original position to accomplish the interference required to latch the components together. Locator features may be inflexible, providing strength and stability in the attachment. Each snap fitting (or snap fit locking pair) 166 may be formed from a hook 168 and an undercut 170. The undercut 170 may be a cantilevered lug; and the hook 168 may be a lip or projection that snaps into the undercut. Assembly of the snap fitting 166 may require temporary deformation of one or both pieces, but the parts may return to an unstressed state in the final assembled position. Additionally, the retaining force of a cantilevered lug may be a function of the bending stiffness of the cantilevered lug. Thus, the lugs may be loaded partially to achieve a tight assembly. Although the retention of each snap fit locking pair 166 may be releasable, the retention may be permanent in certain applications.

As shown in FIG. 26 and FIG. 27, a retention wall 172 and a guide wall 174 may be configured and dimensioned to retain an accessory in the primary receiving channel 176. For example, the retention wall 172 and guide wall 174 may form parallel sides of a channel 178 that may hold the accessory, for example, an entry guide piece 180 within the primary receiving channel 176 of the track when the cover 162 is removed from the receiving portion 164. In FIG. 27, the track is shown in an assembled (or locked) configuration. During installation the recessed, square profile 182 of the upper contour of the track 101 may allow the track to integrate smoothly with drywall and other construction materials without the appearance of cracks or spaces between the finished drywall and track.

Referring to FIG. 25, FIG. 26 and FIG. 27, the track 101 may have a released configuration in which the cover 162 is separated from the other part (Part 2) 164. Thus, the cover 162 may be attached to receiving portion 164, after the receiving portion 164 has been connected to other structural members of the retractable wall system. Likewise, the cover 162 may be removed from the receiving portion 164 after the retractable wall system has been installed. This severability feature allows weight bars to be installed in the primary receiving channel 176 of a horizontal track of a previously erected retractable wall system. It also allows for cabling (e.g., structural, control, or electric cable) to be run through the secondary receiving channel 186 after the retractable wall structure (or awning) has been assembled. Moreover, sound proofing material may be placed inside the track after the retractable wall structure (or awning) has been assembled. The severability feature may improve the constructability of the system, as well as enhance worker safety because handling a track with preloaded weight bars is significantly heavier than handling an empty horizontal track.

Figure 29:
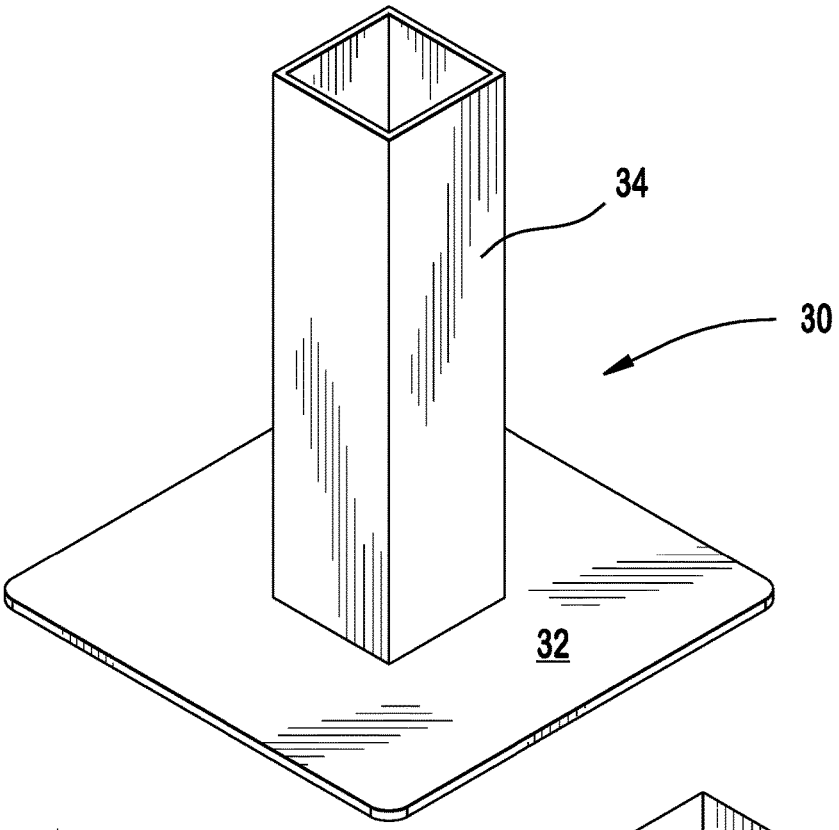
FIG. 29 is a top perspective view of an exemplary base plate of FIG. 1.
Figure 30:
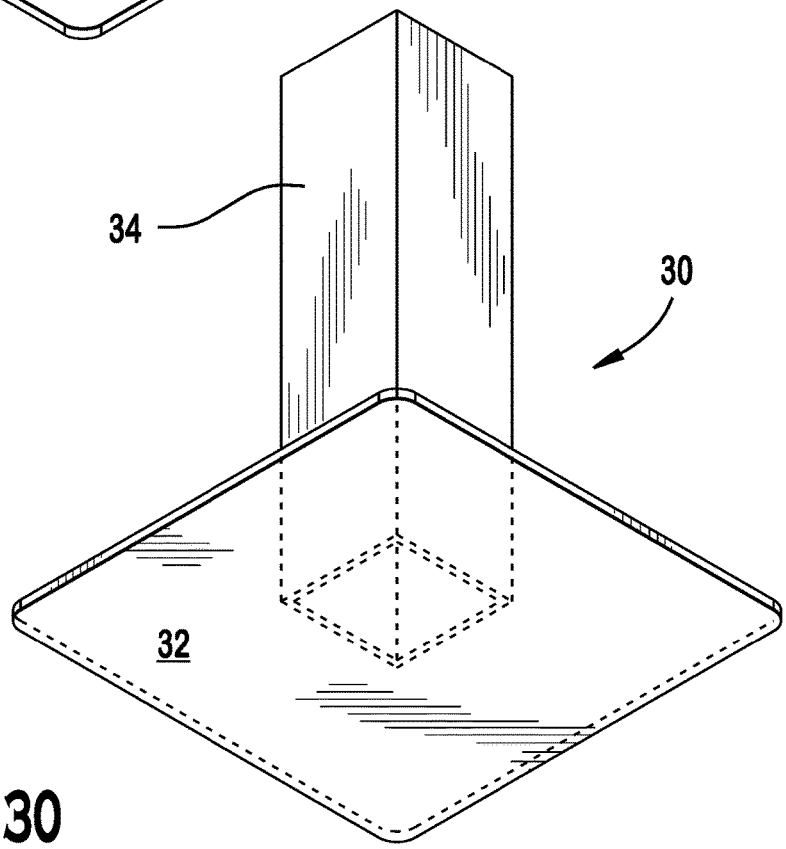
FIG. 30 is a bottom perspective view of the base plate of FIG. 29.

Referring to FIG. 29 and FIG. 30, the projection 34 of the base plate 30 may be received in the core 36 of the vertical post. Preferably, the base plate 30 is made of steel or a heavy material to provide stability to the structure.

Figure 28:
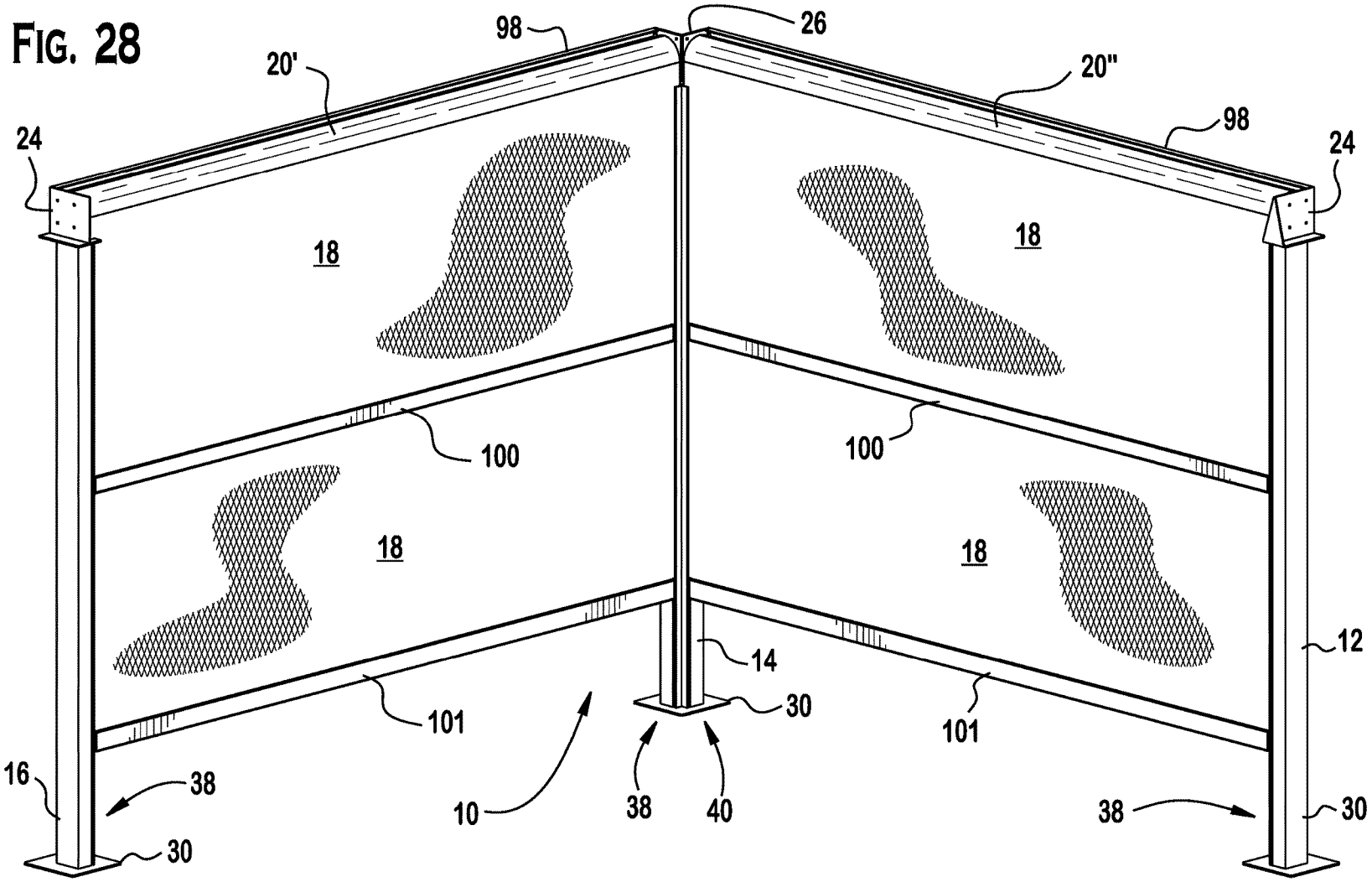
FIG. 28 is another perspective view of the modular wall system of FIG. 1.

FIG. 28 shows another perspective view of the modular wall system of FIG. 1 with the drum cover removed. The vertical posts 12, 14 and 16 are disposed on the base plate 30 to form a free standing column for the modular wall system 10. The vertical posts receive either the side bracket 24 or the corner bracket 26 in the core or large rectangular section 30. One roller assembly 20' is disposed between one side bracket and the corner bracket and another roller assembly 20" is disposed between the other side bracket and the corner bracket. The cage for the screen drum cover may include the side bracket 24, corner bracket 26, and channel irons 98 disposed between the brackets. The flexible barrier material 18 of each roller assembly may be disposed in the slots 28, 40 of the vertical posts. The sheets of flexible barrier material 18 may be connected by a center track 100 and the bottom of the lower sheet of flexible barrier material may be connected to a horizontal track 101 that includes a weight bar to assist in lowering the retractable wall system. By using these components, a modular wall system may be created to form a roll up partition for a room or a free standing structure.

While it the present invention, it will be understood by those skilled in the art that various changes and modifications may be made, and equivalents may be substituted for elements thereof without departing from the true scope of the invention. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A track for connecting a pair of flexible membrane barrier segments comprising:

a first track component having a first longitudinal axis and a first cross-sectional profile perpendicular to the first longitudinal axis which comprises a base surface;

a latching surface that is spaced from the base surface and which comprises a first groove aligned with the first longitudinal axis, a second groove spaced from the first groove, a projecting element located between the first groove and the second groove, the projecting element comprising a first wall which extends away from the latching surface, a second wall adjacent to the first wall, a third wall adjacent to the second wall, the second and third wall defining a ledge between the second wall and the third wall, a fourth wall extending from the latching surface toward the third wall, the first wall, second wall, third wall and fourth wall bounding a first passage, the third wall and the fourth wall defining a seat and a slot which connects the seat to the first passage, a hooking element spaced from the projecting element, and a guide surface disposed between the projecting element and the hooking element.

2. A connection piece for a retractable wall system comprising:

the track of claim 1; and a second track component interlocked with the first track component.

3. The connection piece of claim 2, wherein the first track component and the second track component share a common profile.

4. The connection piece of claim 2, wherein the second track component comprises a second longitudinal axis and a second cross-sectional profile perpendicular to the second longitudinal axis, the second cross-sectional profile comprising a second base surface;

a second latching surface that is spaced from the second base surface and which comprises a third groove aligned with the second longitudinal axis, a fourth groove spaced from the third groove, a second projecting element located between the third groove and the fourth groove.

5. The connection piece of claim 4, wherein the second track component further comprises a second hooking element spaced from the second projecting element and a second guide surface disposed between the second projecting element and the second hooking element.

6. The connection piece of claim 5, wherein the projecting element mates with the second hooking element and the second projecting element mates with the hooking element.

7. The connection piece of claim 4, wherein the second projecting element further comprises a fifth wall which extends away from the second latching surface, a sixth wall adjacent to the fifth wall a seventh wall adjacent to the sixth wall, the sixth and seventh wall defining a second ledge between the sixth wall and the seventh wall, an eighth wall extending from the second latching surface toward the seventh wall, the fifth wall, sixth wall, seventh wall and eighth wall bounding a second passage, the seventh wall and the eighth wall defining a second seat and a second slot which connects the second seat to the second passage.

8. The connection piece of claim 7, wherein the first slot faces away from the second projecting element and the second slot faces away from the first projecting element.

9. A retractable wall system comprising:

the connection piece of claim 2, a first flexible barrier material segment connected to the projecting element, and a second flexible barrier material segment connected to the second track component.

10. The retractable wall system of claim 9, further comprising a horizontal track, the horizontal track being connected to the first flexible barrier material segment.

11. The retractable wall system of claim 9, wherein the first flexible barrier material segment comprises a sheet of mass loaded vinyl.

12. The retractable wall system of claim 9, wherein the second flexible barrier material segment comprises a fabric.

13. The retractable wall system of claim 12, wherein the fabric is capable of receiving a print design.

14. The retractable wall system of claim 12, wherein the fabric is vinyl.

15. The retractable wall system of claim 12, wherein the fabric is cotton.

16. The retractable wall system of claim 12, wherein the fabric is rayon.

17. The retractable wall system of claim 12, wherein the fabric is polyester.

18. A retractable wall system comprising:

a tube which comprises a longitudinal axis;

a first post perpendicular to the longitudinal axis;

a second post spaced from the first post;

the track of claim 1 intermediate to the first post and the second post; and a flexible barrier material segment connected to the tube and the track of claim 1.

19. The retractable wall system of claim 18, further comprising:

a second track component interlocked with the track of claim 1, and another flexible barrier material segment connected to the second track component.

20. The retractable wall system of claim 19, wherein the flexible barrier material segment and the other flexible barrier material segment comprise mass loaded vinyl.

* * * * *